United States Patent [19]

Fluck et al.

[11] 3,955,768

[45] May 11, 1976

[54] APPARATUS FOR PRODUCING WASTE WRAPS AND THREAD RESERVE WINDINGS ON A BOBBIN TUBE

[75] Inventors: Jakob Fluck; Felix Graf, both of Winterthur; Albert Rüegg, Pfaffikon, all of Switzerland

[73] Assignee: Rieter Machine Works, Ltd., Winterthur, Switzerland

[22] Filed: Apr. 21, 1975

[21] Appl. No.: 569,771

[30] Foreign Application Priority Data

Apr. 29, 1974 Switzerland ..... 5816/74

[52] U.S. Cl. ..... 242/18 PW

[51] Int. Cl.[2] ..... B65H 54/34

[58] Field of Search ..... 242/18 PW

[56] References Cited

UNITED STATES PATENTS

| | | | |
|---|---|---|---|
| 3,520,483 | 7/1970 | Swallow | 242/18 PW |
| 3,595,490 | 7/1971 | Schnetzer et al. | 242/48 |
| 3,907,217 | 9/1975 | Graf | 242/18 PW |

FOREIGN PATENTS OR APPLICATIONS

| | | | |
|---|---|---|---|
| 1,236,463 | 6/1971 | United Kingdom | 242/18 PW |

*Primary Examiner*—William D. Martin, Jr.
*Attorney, Agent, or Firm*—Werner W. Kleeman

[57] ABSTRACT

Apparatus for producing waste wraps and thread reserve windings on a bobbin tube which is placed onto a rotating bobbin chuck and at a face side of which there is provided a thread catching zone. For the purpose of producing the waste wraps there is provided a first lever which is arranged to be pivotable with a delay and for producing the thread reserve wraps a second pivotable lever arranged axially offset with respect to the first lever as seen from the face side. Both levers are pivotable in such a manner that they are consecutively pivoted away by the thread caught by the rotating package tube and with different delays while wraps are wound beginning at the face side with the thread tending to move along a thread guide edge towards a central position.

10 Claims, 7 Drawing Figures

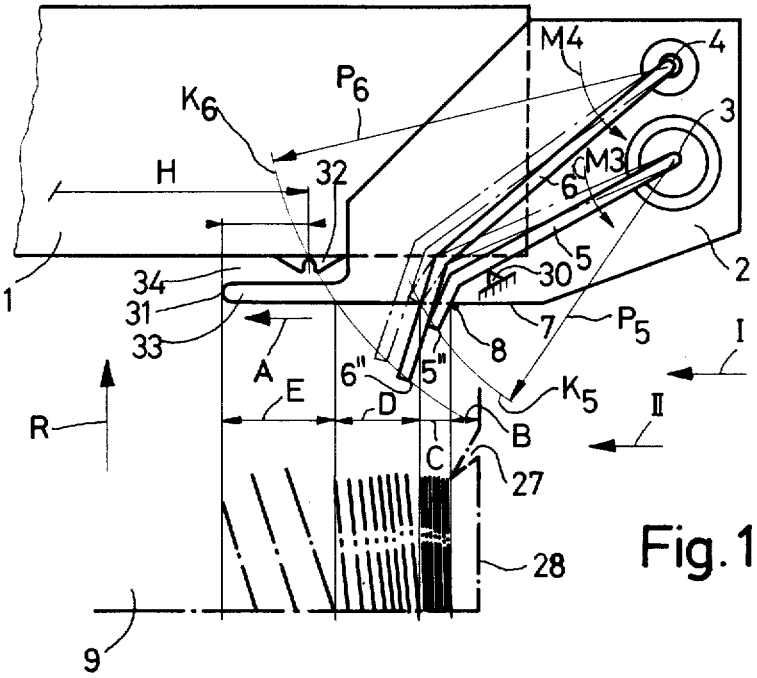
Fig. 1
Fig. 4
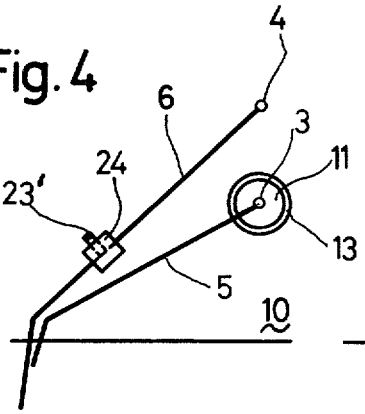
Fig. 5
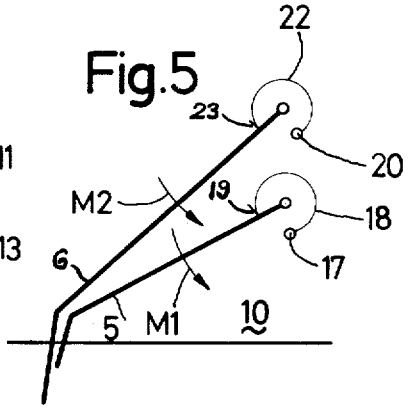

P6
K6
S
6
25
P5
5
F
33
8
E
A
D
G
C
K5
B
27
9

P6
S
6
K6
5
33
26
8
2
E
A
D
P5
K5
G
C
27
9
B

APPARATUS FOR PRODUCING WASTE WRAPS AND THREAD RESERVE WINDINGS ON A BOBBIN TUBE

BACKGROUND OF THE INVENTION

The present invention relates to a new and improved construction of apparatus for producing waste wraps and thread reserve wraps or windings on a bobbin tube placed on a driven bobbin chuck as such is used for building bobbin packages of endless threads.

Devices for forming waste wraps and thread reserve wraps on bobbin tubes are already known to the art wherein the thread for the formation of waste wraps is guided along a thread guide edge which does not form a straight line and subsequently, for the formation of reserve wraps or windings, is guided in a tooth gap of a toothed gear which rotates at a speed which is reduced by the inertia of the toothed gear itself and additionally under the influence of a magnet acting upon the toothed gear.

The disadvantages of this prior art system reside, on the one hand, in the complicated and thus expensive construction and design and, on the other hand, by virtue of the fact that the thread reserve wraps, due to the thread guiding action which is not effected in a straight line in the rotating toothed gear, form different helix angles on the bobbin tube. Furthermore, no marked increase of the thread helix angle is formed between the waste wraps and the thread reserve wraps in a manner such that the waste wraps and the thread reserve wraps are distinctly separated. Thus, the danger arises that the machine operator eliminates either too few waste wraps or too many reserve wraps.

SUMMARY OF THE INVENTION

Thus it is a primary objective of the present invention to provide an improved construction of apparatus for producing waste wraps and thread reserve wraps by means of which, on the one hand, the waste wraps are placed closely together or superimposed in a completely automated manner and, on the other hand, the thread reservice wraps are formed in a sufficient number and clearly distinguishable from the waste wraps with a sufficiently large thread helix angle.

It is a further object of the invention to adjust in a simple manner the length or the number respectively, of these wraps.

It is a further object of the present invention to provide apparatus of the aforementioned character which uses simple and thus economical elements.

Another object of the invention is to be able to adapt the elements in simple manner to the winding speeds, the thread tensions and the thread thickness.

Now in order to achieve these and still further objects of the invention, which will become more readily apparent as the description proceeds, the inventive apparatus for producing waste wraps and thread reserve windings on a bobbin tube which is placed onto a rotating bobbin chuck and at a face side of which there is provided a thread catching zone, is manifested by the features that there are provided a first lever for producing the waste wraps, this first lever being arranged to be pivotable with a delay, and a second lever for producing the thread reserve wraps, this second lever being pivotable and arranged axially offset with respect to the first lever as seen from the face side. Both levers are pivotably arranged in such a manner that they are consecutively pivoted away by the thread caught by the rotating package tube and with different delays while wraps are wound beginning at the face side, the thread tending to move along a thread guide edge towards a central position. In this arrangement the levers can be pivotably supported in the direction of the thread movement in a plan which is inclined with respect to the horizontal plane. The first lever can be connected at one end with a cylinder which is inserted into a liquid-filled bore of a support member in which it can be rotatably supported.

According to an alternative embodiment of the invention the levers can be arranged to be pivotable in a horizontal plane, there being provided springs attached at one end to the support member and at the other end generating a torque or rotational moment at the levers and which counteracts the force of the thread tending to move towards the central position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 illustrates an apparatus for producing waste wraps and thread reserve wraps on a bobbin package tube, the apparatus being shown semi-schematically in top plan view;

FIGS. 4 and 5 respectively schematically illustrate variant constructions of the levers according to FIGS. 1 through 3.

DETAILED DESCRIPTION OF THE INVENTION

Figures 2, 3:
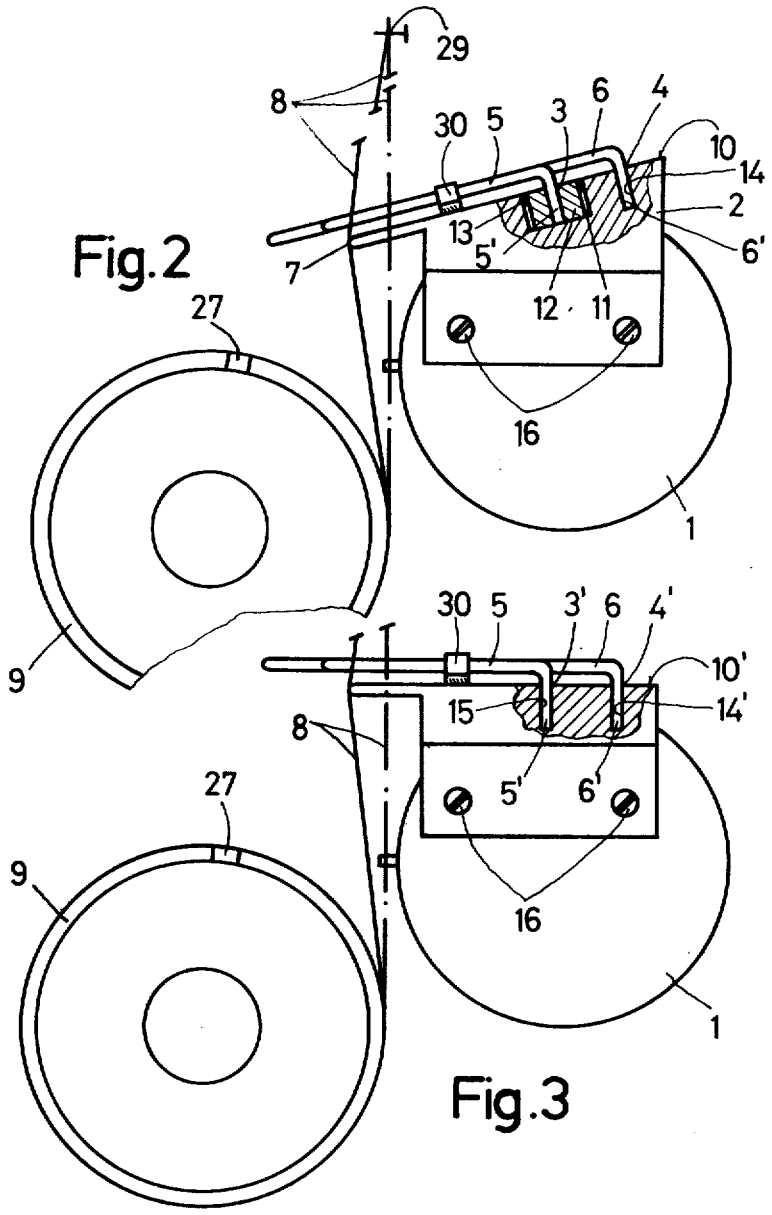
FIG. 2 illustrates the apparatus according to FIG. 1 seen looking in the direction designated by reference character I in FIG. 1, the levers being arranged inclined with respect to the horizontal plane.
FIG. 3 illustrates the apparatus according to FIG. 1 seen looking in the direction designated by reference character I in FIG. 1, the levers being arranged substantially horizontally.

Describing now the drawings, there is mounted on a guide member 1 for a thread guide, which is part of a suitable winding device (not shown), a support member 2 (FIGS. 1 and 2). The support member 2 carries the levers 5 and 6 respectively, which are mounted to be pivotable about the pivoting centers or pivot points 3 and 4 respectively. The free ends 5'' and 6'' of levers 5 and 6 are slightly bent. In this arrangement the end 5'' of the lever 5 moves along a circle $K_5$ having the radius $P_5$ and the end 6'' of the lever 6 moves along a circle $K_6$ having the radius $P_6$. Along a thread guide edge 7 of the support member 2 there is guided a thread 8 delivered by any processing stage preceding the thread winding stage, guiding of such thread 8 occurring within a zone which, viewed in the thread shifting direction A (FIG. 1), begins in front of a thread catching zone B (FIG. 1) of a bobbin package tube 9 (shown with dash-dotted or broken lines and only partially in FIGS. 1, 6 and 7 and with solid lines in FIGS. 2 and 3) and ends within a thread traversing zone H. A surface 10 of the support member or support 2 is slightly inclined with respect to the horizontal plane in the direction of the thread 8 (FIG. 2). At its pivoting point or axis 3 the lever 5 is connected by means of its end 5' which is bent at right angles with a cylinder 11 which is rotatably supported in a bore 12 provided in the support member 2 and filled with a liquid of a predetermined or given viscosity. Leaking or escape of the liquid is prevented by means of a gasket 13 or equivalent expedient (FIGS. 2 and 4). The lever 6 is likewise rotatably supported at its pivoting point or axis 4 by means of its bent end 6' in a bore 14 (FIG. 2) of the support member 2. The weight of the individual levers 5 and 6, owing to their inclined position, generates a respective torque or rotational moment M3 and M4.

In FIG. 3 there is illustrated an alternative embodiment wherein the support member 2 is provided with a horizontal surface 10'. The lever 5 is rotatably supported at its pivoting point or axis 3' by means of its bent end 5' in a bore 15 of the support member 2 and the lever 6 is rotatably supported at its pivoting point or axis 4' by means of its bent end 6' in a bore 14' of the support member 2. The support member 2 is screwed onto the guide member 1 of the thread guide by means of screws or threads 16.

A tension spring 18 (FIG. 5) which is connected via a holder 17 with the support member 2, owing to the force transmitted to the lever 5 at the contact or engagement point 19, produces a torque or rotational moment M1 acting in the counter-clockwise direction, whereas a tension spring 22 connected via a holder 20 with the support member 2 and transmitting a force onto the lever 6 at the contact or engagement point 23 generates a torque or rotational moment M2 which also acts in the counter-clockwise direction.

A further embodiment of the invention is shown in FIG. 4 where the lever 6 is provided with a slidable weight 24 or the like which can be fixed by a set screw 23'. The torque or rotational moment $M_4$ thus can be varied.

Furthermore, the support member 2 can be provided with a stop 25 (FIG. 6) in such a manner that the pivoting movement S of the lever 6 is limited.

Also the pivoting movement S of the lever 6 can be limited by an additional stop 26 (FIG. 7) provided on the lever 5 in such a manner that there is prevented mutual contact of both levers 5 and 6 respectively, in the end zone bent or flexed at right angles.

Furthermore, in the arrangement shown in FIG. 2 the levers 5 and 6 can be combined with the springs 18 and 22 respectively, as shown in FIG. 5, in such a manner that the torque or rotational moment $M_3$ and $M_4$ respectively, acting upon the levers 5 and 6 respectively, is increased. Also, the arrangements of the levers 5 and 6 shown in FIGS. 4 and 5 can be combined with the arrangement of the levers 5 and 6 shown in FIG. 2, whereas in the horizontal pivoting arrangement of the levers 5 and 6 respectively, shown in FIG. 3 there is necessary the arrangement of the levers 5 and 6 respectively, as shown in FIG. 5.

The function of the described embodiments during operation will be now considered in detail and is as follows: An operator or instead of the operator an operating device (both not shown) using a suction nozzle or suction gun known as such (not shown) brings the thread 8 or the like in the direction designated by reference character II (FIG. 1) to, or into, a catching or catch slot 27 at the face side or end face 28 of the tube 9. Thus, the thread 8 sucked-in by the suction nozzle is caught and severed in such a manner that the thread 8 is wound onto the tube 9 rotating in the direction R (FIG. 1). Owing on the one hand to the usual thread tension needed for winding, and owing to the action of a thread guide 29 also known as such in this art and located above the tube (FIG. 2), the thread tends to move along the guide edge 7 in the direction A (FIG. 1) towards a central position with respect to the length of the tube 9. This movement of the thread 8, however, is delayed or retarded by the lever 5 which in its starting position is located at a stop 30 and by the lever 6 contacting the lever 5 in such a manner that the thread 8 moves both levers by pivoting them against the resistance of the friction of the liquid provided in the bore 12, on the one hand, and against the resistance generated by the inertia of the levers, on the other hand, until the levers are moved (behind the thread guide edge 7) out of the path of movement of the thread 8 along the guide edge 7. In this process the delays of the thread movement effected by the arrangements of the levers 5 and 6 described with reference to FIGS. 1 through 5 are different in such a manner that in a waste winding zone C, in which the levers 5 and 6 simultaneously delay the movement of the thread 8 along the guide edge the wraps are formed closely adjacent and/or also partially superimposed, while in a thread reserve winding zone D the wraps are placed further apart, and in a zone E, i.e. after the lever 6 also has been pivoted behind the thread guide edge 7, and in which zone E the thread thus can slide without delay along the guide edge 7 in accordance with the winding angle generated by the thread tension, the thread wraps are relatively far apart. Thereafter, the thread 8, owing to the thread tension, slides over the end 31 of the thread guide edge 7 into a free position indicated with dash-dotted lines in FIGS. 2 and 3. In this thread position, which already is within the traversing zone H, the thread 8 is caught by the traversing thread guide 32 which traverses to-and-fro within the traversing zone H in such a manner that there begins the regular build-up of the thread package. In order to positively bring the thread into the traversing zone H by means of the thread guide edge 7 the support member 2 is formed so as to provide a nose 33 extending over a length F (see e.g. FIG. 6), so that there is maintained a free room or space 34 for the traversing thread 8. The length f of the nose or nose member 33 can be equal to one-sixth of the traversing zone length H.

Figure 6:
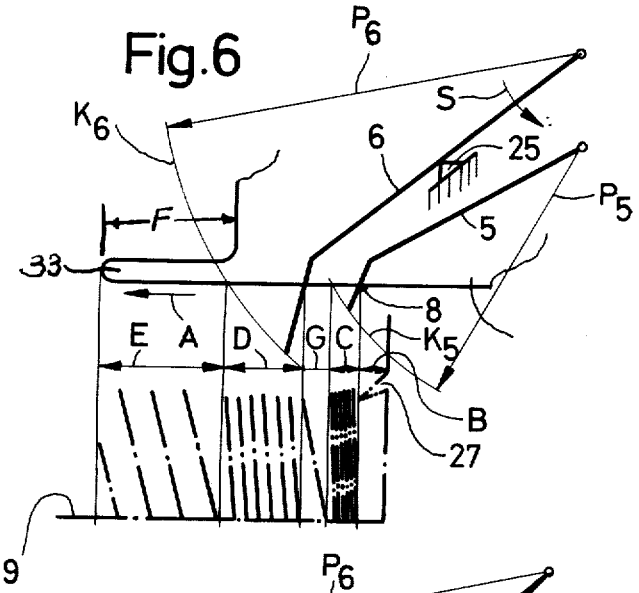
FIGS. 6 and 7 respectively illustrate alternative arrangements of the levers according to FIGS. 1 through 5 for producing an alternative arrangement of the wraps on the bobbin package tube.
Figure 7:
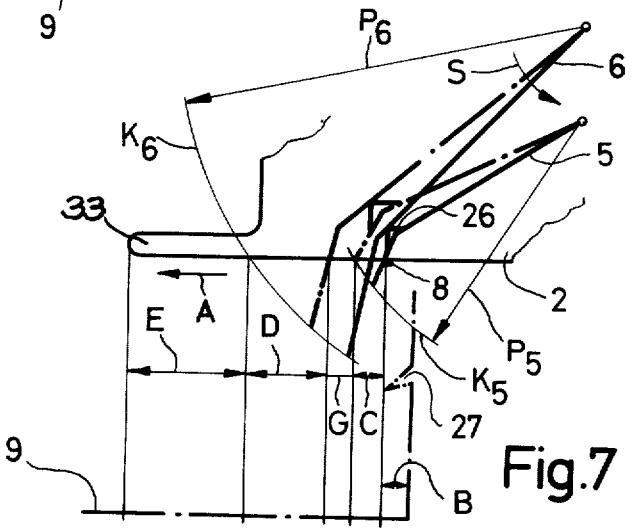

The additional stops 25 and 26 respectively shown in FIGS. 6 and 7 prevent the levers 5 and 6 from bearing against one another in their starting position (the starting or initial position being indicated by solid lines in FIGS. 6 and 7), so that the thread 8 moving in the direction A, upon formation of the previously described waste wraps, jumps or leaps over to the lever 6 which is in its starting position in such a manner that there is wound an intermediate zone G (FIGS. 6 and 7), i.e. a zone in which large distances between the wraps are formed. This intermediate zone G creates a distinct distance between the waste wraps and the thread reserve wraps.

Some of the more notable advantages of the present invention can be enumerated as follows:

a. the different embodiments of apparatus for producing the waste wraps and thread reserve wraps are of utmost simplicity in construction and design and thus are economically feasible as concerns their manufacturing costs;

b. the aforedescribed means can be accommodated to the winding speeds, the thread tensions as well as the thread thickness in a most simple manner;

c. the length, or the number, respectively, of the waste wraps and of the thread serve wraps respectively, can be changed in a most simple manner;

d. the apparatus can be employed independently of the nature of the supply of the thread to the thread catching zone; and e. the formation of the waste wraps and the thread reserve wraps is effected fully automatically and the apparatus also automatically returns into its starting position.

While there is shown and described present preferred embodiments of the invention, it is to be distinctly understood that the invention is not limited thereto, but may be otherwise variously embodied and practiced within the scope of the following claims. Accordingly,

What is claimed is:

1. An apparatus for producing waste wraps and thread reserve wraps on a bobbin tube onto which there is wound a thread package and which is placed onto a rotating bobbin chuck and at an end portion of which there is provided a thread catching zone, comprising a first lever for producing the waste wraps, means for mounting said first lever to be pivotable with a delay, a second lever for producing the thread reserve wraps, means for mounting said second lever to be pivotable and axially offset with respect to the first lever as viewed from said end portion, means for providing a thread guide edge, both of said levers being pivotably arranged in such a manner that said levers are consecutively pivoted by the thread engaged by the rotating package tube and with different delays while thread wraps are wound beginning at the end portion and with the thread tending to move along the thread guide edge towards a central position.

2. The apparatus according to claim 1, wherein the thread guide edge extends subsstantially parallel to the lengthwise axis of the bobbin tube and guides the thread at least during the formation of the waste wraps and the thread reserve wraps.

3. The apparatus according to claim 1, wherein said mounting means are provided with support means so that said levers are pivotably supported in the direction of the movement of the thread in a plane which is inclined with respect to a horizontal plane, and delay means acting upon the first lever.

4. The apparatus according to claim 3, wherein said mounting means for the first lever pivotably mounts an end of said first lever at a pivot point, said support means being provided with a bore, a cylinder inserted into said bore of the support means, said first lever end being connected with said cylinder, and said delay means comprising a liquid of predetermined viscosity provided in a space between said cylinder and said bore.

5. The apparatus according to claim 3, wherein the second lever is provided with a slidable weight.

6. The apparatus according to claim 1, wherein said mounting means are provided with support means so that said levers are pivotably supported in a substantially horizontal plane, spring means acting upon the levers for generating a respective torque counteracting the movement of the thread tending to move towards said central position.

7. The apparatus according to claim 1, wherein the thread guide edge, as viewed in the axial direction from the end portion, extends past a pivoting circle of the second lever and into a normal thread traversing zone.

8. The apparatus according to claim 1, wherein a pivoting circle of the first lever intersects the thread guide edge at a point which, as viewed in the axial direction from the end portion, is located in front of a point of intersection of the second lever when in its starting position with the thread guide edge.

9. The apparatus according to claim 8, wherein the first lever is provided with a stop for maintaining a determined distance between said first and second levers.

10. The apparatus according to claim 3, wherein said levers which are pivotably arranged in the inclined plane are further provided with spring means for generating a respective torque which counteracts the thread moving towards said central position.

* * * * *